US008205690B2

(12) United States Patent
Evans

(10) Patent No.: US 8,205,690 B2
(45) Date of Patent: Jun. 26, 2012

(54) DUAL ACTING LOCKING JAR

(76) Inventor: Robert W. Evans, Montgomery, TX (US)

( * ) Notice: Subject to any disclaimer, the term of this patent is extended or adjusted under 35 U.S.C. 154(b) by 231 days.

(21) Appl. No.: 12/723,196

(22) Filed: Mar. 12, 2010

(65) Prior Publication Data

US 2011/0220345 A1 Sep. 15, 2011

(51) Int. Cl.
*E21B 4/14* (2006.01)

(52) U.S. Cl. ..... 175/297; 175/299; 166/178

(58) Field of Classification Search ..... 175/299, 175/296, 297; 166/178, 301
See application file for complete search history.

(56) References Cited

U.S. PATENT DOCUMENTS 3,494,417 A * 2/1970 Fredd ..... 166/73
3,685,598 A * 8/1972 Nutter ..... 175/302
4,361,195 A 11/1982 Evans
5,170,843 A * 12/1992 Taylor ..... 166/301
5,232,060 A * 8/1993 Evans ..... 175/297
5,624,001 A 4/1997 Evans
6,290,004 B1 9/2001 Evans
6,481,495 B1 * 11/2002 Evans ..... 166/65.1
6,866,104 B2 * 3/2005 Stoesz et al. ..... 173/1
7,510,008 B2 * 3/2009 Evans ..... 166/301
2005/0092495 A1 * 5/2005 Evans ..... 166/301

* cited by examiner

*Primary Examiner* — Nicole Coy
(74) *Attorney, Agent, or Firm* — John J. Love; Claude E. Cooke, Jr.; Cooke Law Firm

(57) ABSTRACT

A double action locking jar is operable to provide a jarring force in an upward or downward direction. A pair of pressure pistons form a pressure chamber in which a Belleville spring stack is located. A metering orifice in one of the pistons serves to provide a delay mechanism for release of a mandrel within the housing. Two collets are located within the housing for mechanically releasing the mandrel when a tension or compression force is applied to the mandrel. The jar may be mechanically actuated only by allowing the pistons to freely move within the housing without hydraulic resistance.

12 Claims, 6 Drawing Sheets

DUAL ACTING LOCKING JAR

BACKGROUND OF INVENTION

1. Field of Invention

This invention is directed to a work string jar which is capable of applying an upward or downward jarring force on a work string used in oil or gas wells.

2. Description of Related Art

Double acting jars are known in the prior art however they have certain drawbacks. A known double acting jar is disclosed in U.S. Pat. No. 5,624,001. This jar requires two sets of Belleville spring stacks which add to the complexity and length of the jar. The high pressure seals within the tool are exposed to the drilling mud which can cause premature failure due to the corrosive and abrasive nature of the drilling mud. Furthermore each of the pressure pistons requires an orifice and a check valve. Also this prior art jar does not include a trigger sleeve which reduces wear on the collet and release mechanism.

SUMMARY OF THE INVENTION

A sealed double acting jar with a floating piston to balance the interior fluid with hydrostatic pressure, and a hammer and anvil surface is disclosed. The jarring mechanism includes two pressure pistons which oppose each other to form a substantially sealed pressure chamber. A spring is positioned between the pressure pistons such that when one piston is moved toward the other piston, the spring creates a mechanical resistance at the same time as the compression of the fluid between the pistons creates a pressure, both of which resists movement of the piston. By requiring the piston to move a given distance the minimum load at the trigger point of the jar can be controlled by the compression of the Belleville spring stack. The actual load at the trigger point is a result of the tensile or compressive load placed on the jar by the work string and is balanced by the pressure differential across the piston acting on the cross sectional area of the piston. At least one pressure piston has a first flow passage or an orifice device to control the time delay and at least one pressure piston has a second flow passage or a check valve to allow the fluid to return to the pressure chamber. The jar has separate trigger mechanisms for jarring in tension or compression, however each is a mirror of the other. Each consists of a compression sleeve to transfer the jar load from the collet to the pressure piston, a trigger sleeve to allow the collet to release the inner mandrels after the specified travel has occurred and a coil spring to allow the trigger sleeve to move axially with respect to the collet to prevent damage to the load bearing surfaces. When jarring in either direction the non load bearing collet remains attached to and moves with the mandrel. The pressure pistons slide and seal on a flow sleeve. A fluid passageway is provided which allow the portions of the fluid chambers above and below the pressure pistons to communicate so that the fluid surrounding the chamber defined by the pressure pistons is maintained at hydrostatic pressure.

This configuration has many advantages over the existing art. The spring can be configured to define a minimum jarring load. This prevents the tool from inadvertently jarring on the surface and eliminates the need to use a safety clamp when racking the tool with drill collars. All of the high pressure is confined to the area between the pressure pistons so that all the seals that are exposed to well bore fluid are balanced with hydrostatic pressure. The collets and spring give a well defined neutral position. This configuration only requires one spring. This design has a hydraulic time delay but triggers mechanically.

According to another embodiment of the invention, the jar may be mechanically triggered only without the hydraulic time delay by allowing for free movement of the pistons within the housing.

DETAILED DESCRIPTION OF THE DRAWINGS

FIGS. 1A to 5A are cross sectional views of the jar in a neutral position.

FIGS. 1B to 5B are cross sectional views of the jar in an upward jarring position.

FIGS. 1C to 5C are cross sectional views of the jar in a downward jarring position.

DETAILED DESCRIPTION OF THE INVENTION

Figures 1A, 1B, 1C:
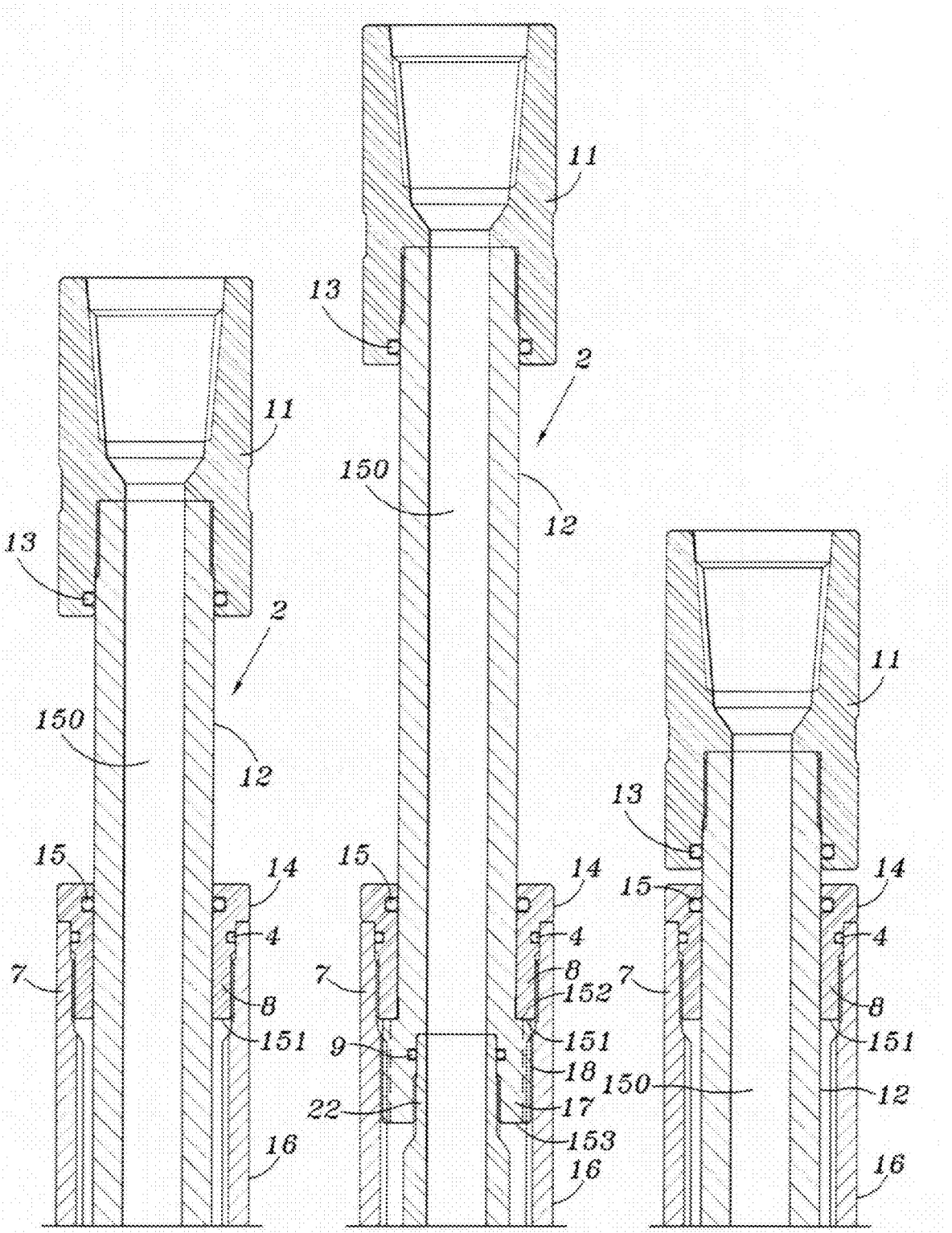

Referring to FIGS. 1A-5A, an embodiment of the invention includes an outer housing comprising several portions. These include a sealing cap 14, a proximal portion 16, a first filling sub 28, a proximal trigger sleeve housing 37, spring housing 68, distal trigger sleeve housing 99, a second filling sub 120, a floating balance piston housing 125 and distal portion 127 which includes threads 129 for connection to a distal portion of the work string.

The various portions of the housing are secured together by any known method. In one embodiment, the portions are secured together by male and female threaded segments for example 7, 8 for the sealing cap 14 and proximal portion 16 of the housing. The first filling sub housing portion 28 has externally threaded stubs 27 and 28 that receive internally threaded portions 5 and 6 of proximal portion 16 and trigger sleeve housing portion 37. Trigger sleeve housing portion 37 is externally threaded at 66 to receive an internally threaded portion 67 of spring housing 68. The distal portion of spring housing 68 is internally threaded at 98 to receive externally threaded portion 90 of distal trigger sleeve housing 99. Second filling sub housing 120 has externally threaded stubs 121 and 122 that connect to internally threaded portion 119 of distal trigger sleeve housing 99 and internally threaded portion 124 of floating balance piston housing 125. The distal portion 126 of floating balance piston housing 125 is internally threaded to receive externally threaded portion 128 of distal housing portion 127. Suitable seals 3, 4, 35, 36, 76, 96, 97, 140, 133, and 144 are provided between the treaded portions.

Located within the housing for axial movement in both directions from a neutral position is a mandrel 2 which also comprises several sections. A mandrel work string connector portion 12 is threadly connected to a work string connection 11. A seal 13 is provided between the connecting portions. The distal portion 17 of the work string connection portion is internally threaded to receive an upper mandrel portion 21 which in turn is internally threaded at 62 to receive an externally threaded portion 63 of central mandrel portion 64. Central mandrel portion 64 is externally threaded at 107 to receive internally threaded portion 103 of distal mandrel portion 113. Distal mandrel portion 113 is externally threaded at 142 to receive internally threaded portion 141 of lower end mandrel portion 160. Suitable seals 9, 10, 106, and 143 are located at the threaded connections. The mandrel has an internal fluid passageway 150 that extends throughout its length.

Figures 2A, 2B, 2C:
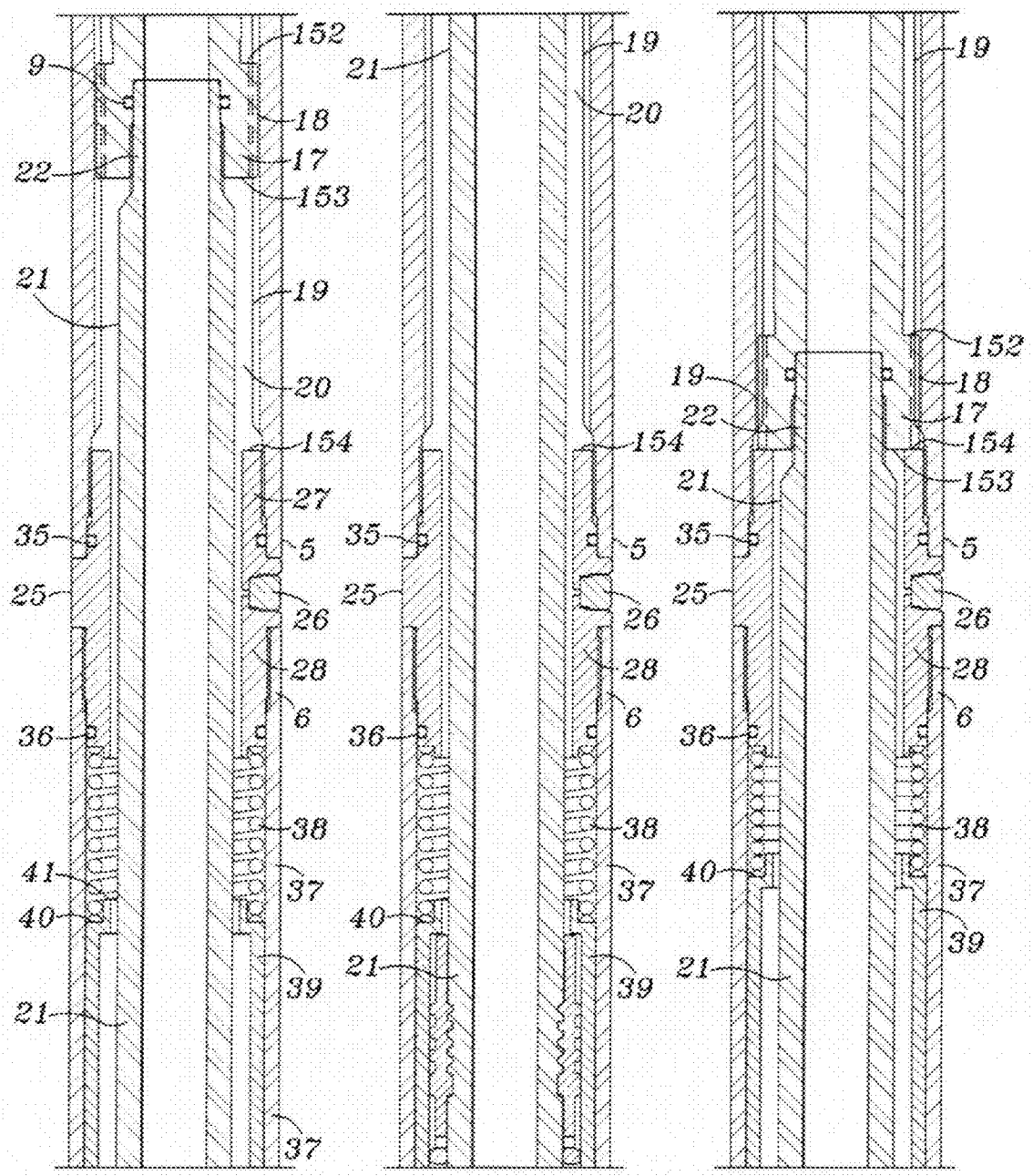

Mandrel connecting portion 12 has an enlarged section 17 that includes a plurality of splines 18 that slide within grooves 19 provided in the inner surface of housing portion 16. An annular fluid filled chamber 20 is located between mandrel portion 21 and housing portion 16. A trigger sleeve 39 is positioned within proximal trigger sleeve housing 37 and includes a plurality of grooves 51 on its inner surface. Trigger sleeve 39 includes a shoulder 40 and a reduced diameter portion 41 as shown in FIG. 2A. A coil spring 38 is captured between stub 28 of first filing sub 25 and the shoulder 40. A first collet 46 is mounted on upper mandrel portion 21 between the mandrel and the trigger sleeve 39. The exterior surface of upper mandrel portion includes a plurality of grooves 50 which interact with a plurality of ribs 52 on the interior of the fingers 49 of collet 46 in a manner to be explained below. Collet 46 also includes a plurality of ribs 47 on the outside of the fingers of the collet that interact with grooves 51 located on the interior surface of the proximal trigger sleeve 39 in a manner to also be described.

A first compression sleeve 54 surrounds the mandrel and is located between the first collet 46 and a first pressure piston 69. Pressure piston 69 is mounted on a flow sleeve 65 which surrounds central mandrel portion 64 and is provided with a seal 71. The piston includes a first flow passage or flow control orifice 78 and a second flow passage or a check valve 79. A plurality of flow channels 70 are formed either in the outer surface of central mandrel portion 64 or on the inner surface of flow sleeve 65 to allow for fluid communication between the chamber or either side of pressure chamber 82.

Figures 3A, 3B, 3C:
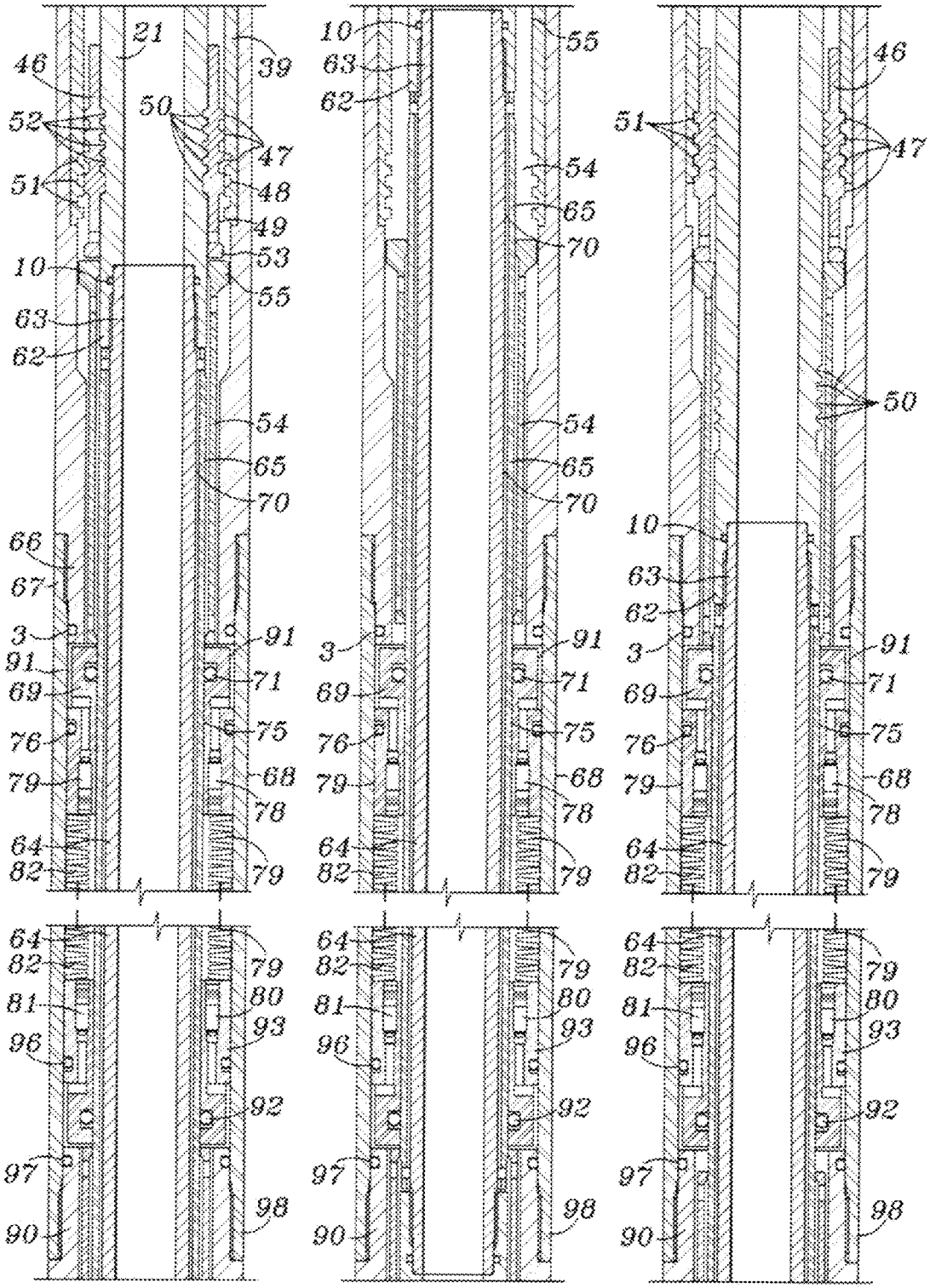
Figures 4A, 4B, 4C:
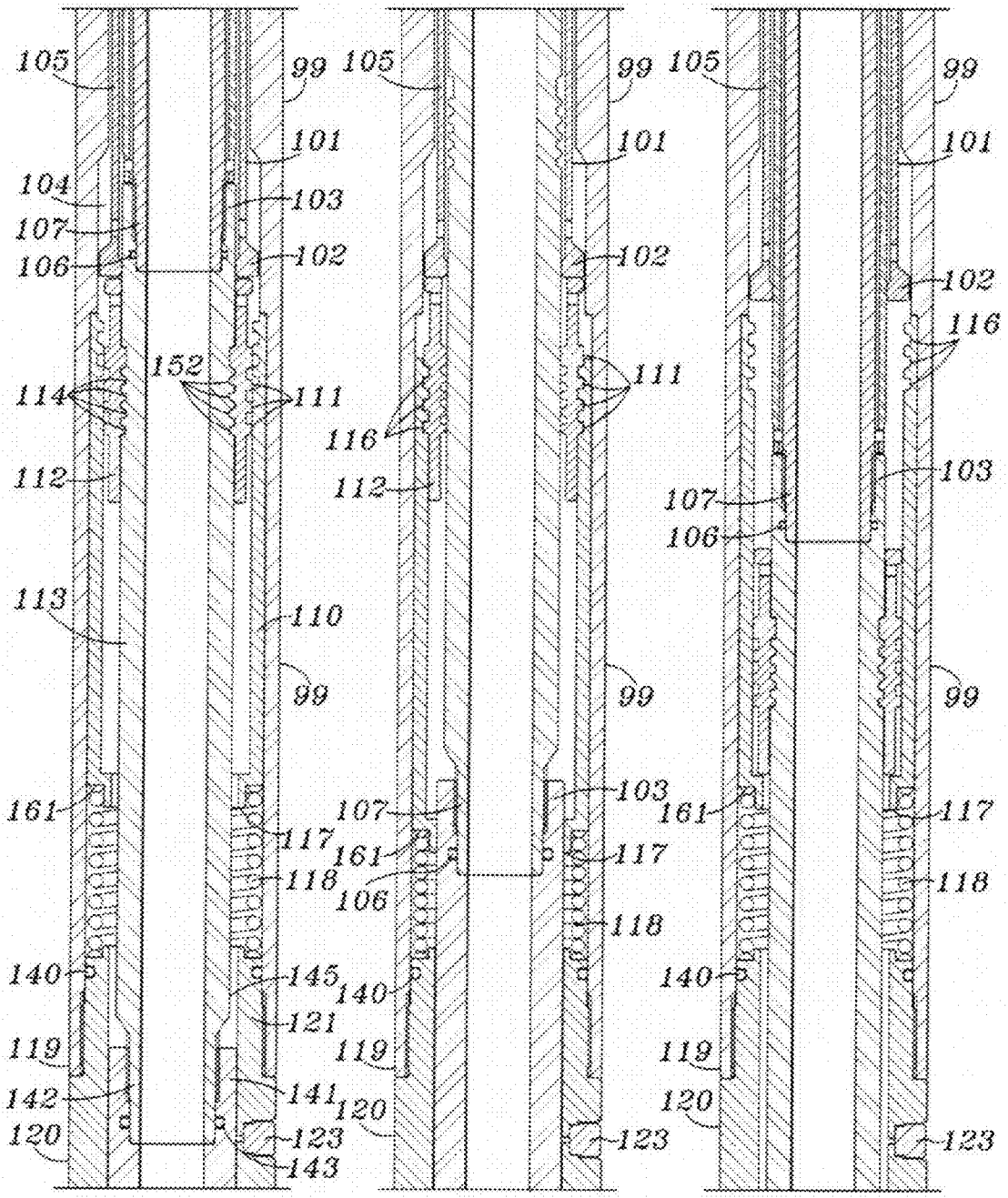
Figures 5A, 5B, 5C:
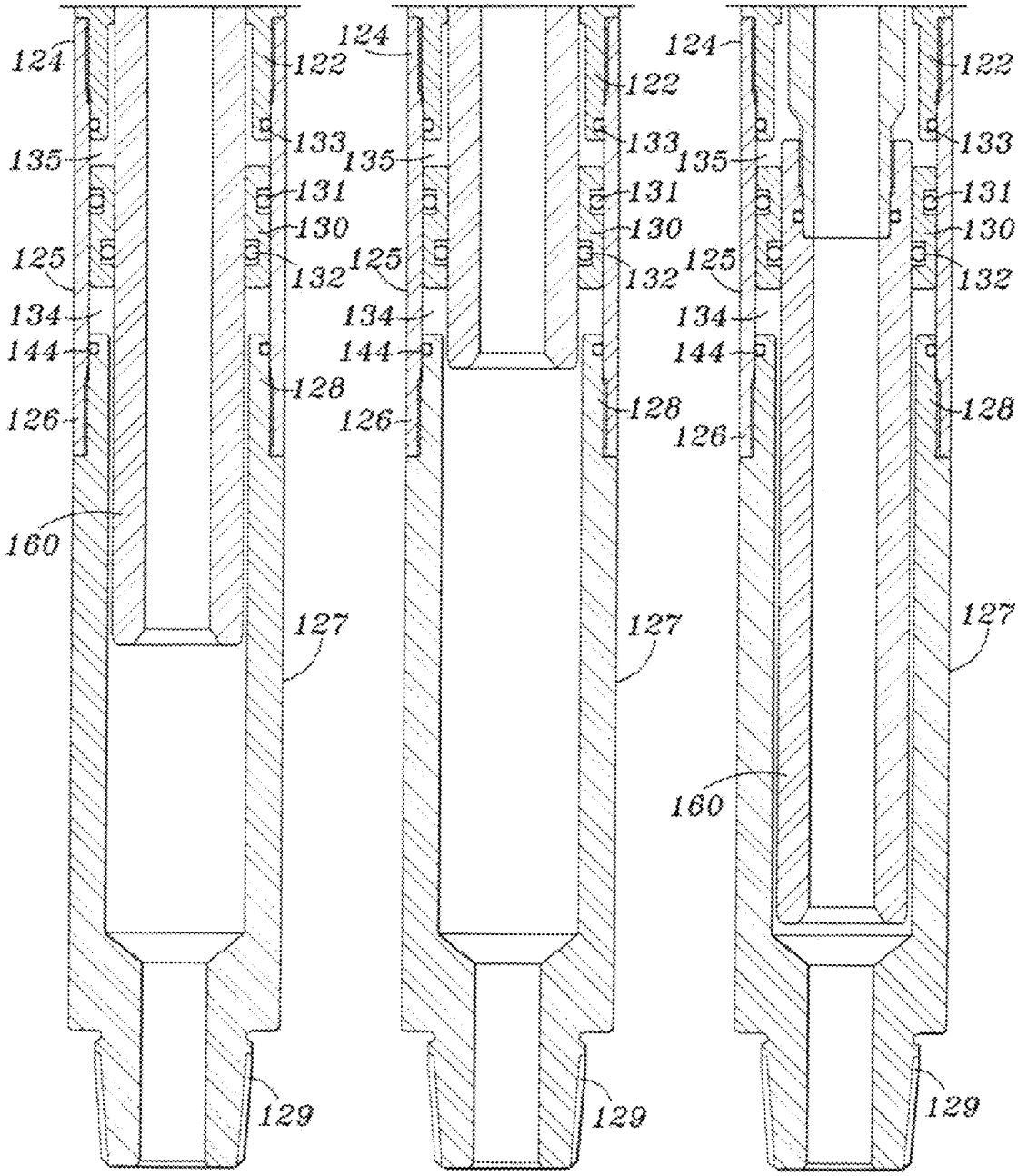

A second pressure piston 93 is mounted on the flow sleeve 65 downhole of the first pressure piston 69 and may include a flow control orifice 80 and a check valve 81 or first and second flow passages. Pressure pistons 69 and 93 are also provided with a flow passage 91 that extend from the metering orifices and check valves to the rear of the pistons as shown in FIG. 3A. A Belleville spring stack 79 surrounds the flow sleeve and extends between pressure pistons 69 and 91 and is confined between them. Although a Belleville spring stack is illustrated, any known spring such as a coil spring may be utilized. Flow sleeve 65 is captured between portion 62 of upper mandrel portion 21 and portion 103 of lower mandrel portion 113. Downhole of the second pressure piston is a second compression sleeve 101 and collet 112 arrangement similar to that of compression sleeve 54 and collet 46. Also a second trigger sleeve 110 surrounds collet 112 and includes a plurality of grooves 116 on its inner surface which interact with a plurality of ribs 111 on the outer surface of the collet fingers. Also distal mandrel portion 113 has a plurality of grooves 152 that interact with a plurality of ribs 114 on the inner surface of the collet fingers. Trigger sleeve 110 includes a shoulder 161 at its distal end and a reduced diameter portion 117. A coil spring 118 abuts shoulder 161 at one and rests on a shoulder of the sub housing 120 at its other end as shown in FIG. 4A. Pressure pistons 69 and 93 along with the metering orifice and check valve or first and second flow passages, serve as an hydraulic delay mechanism for triggering the jar. However, it is within the scope of this invention to allow the pistons to move freely within the housing without causing any hydraulic resistance so that the jar is mechanically actuated only. This can easily be accomplished, for example, by allowing sufficient clearance between the pistons and the housing for unrestricted fluid flow. In this situation the pistons would merely function as spring abutment members.

A floating balance piston 130 having exterior and interior seals 131, 132 floats on lower end mandrel portion 160 in a distal pressure chamber 134 formed between the lower portion 160 of the mandrel and housing portion 125. The distal portion of the pressure chamber 134 is in fluid communication with the fluid passageway 150 in the mandrel, and the proximal portion 135 of pressure chamber 134 is in fluid communication with the interior portion of the tool between the housing and mandrel.

Figure 6:
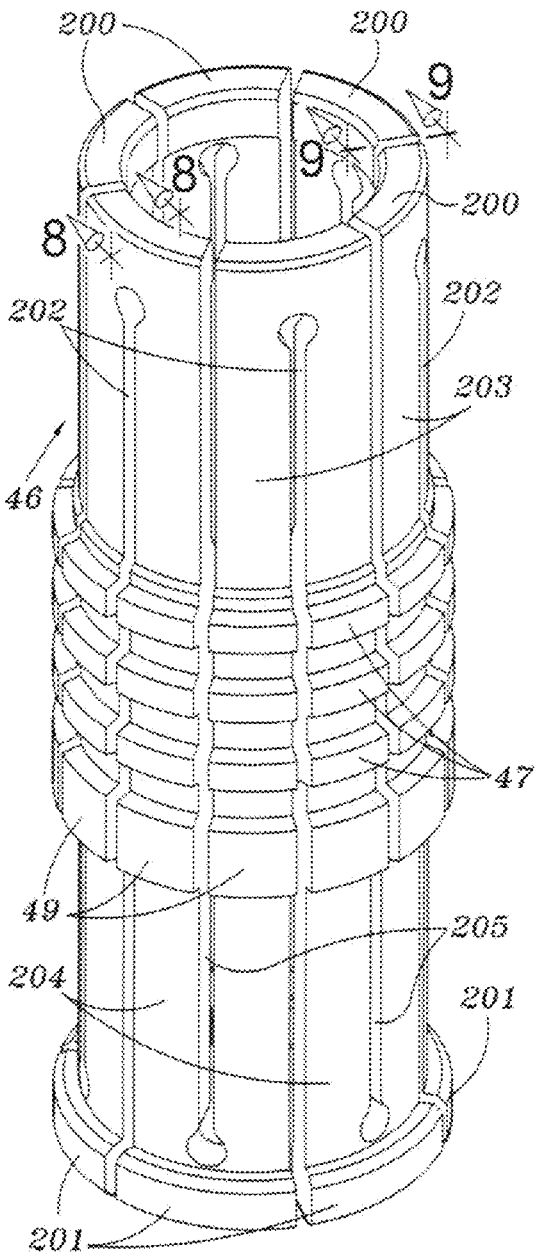
FIG. 6 is a perspective view of one of the collets.
Figure 7:
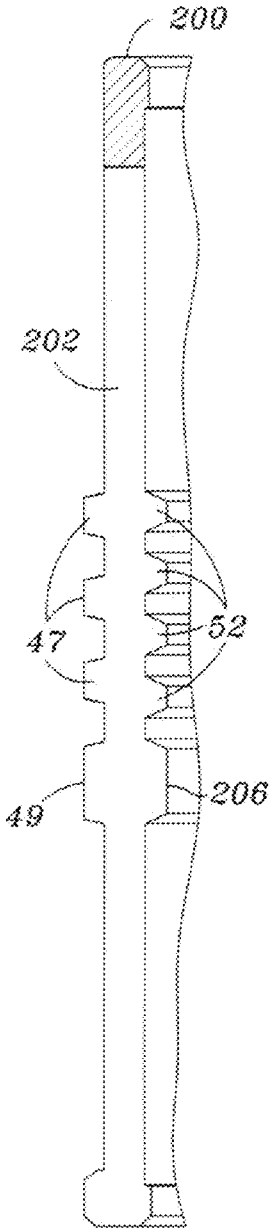
FIG. 7 is a view of the interior and exterior surface of the collet at reference line 8-8 of FIG. 6.
Figure 8:
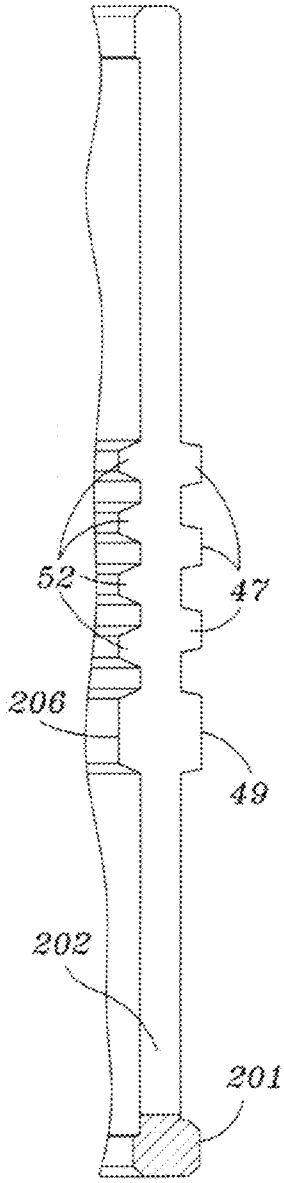
FIG. 8 is a view of the internal and external surface of a collet at reference line 9-9 of FIG. 6.

FIG. 6-8 illustrates the details of collet 46 which is structurally identical to collet 112. Collet 46 includes a plurality of alternating finger portions 203, 204 that are joined at their top looking at FIG. 6 by arcuate solid portions 200. At their bottom, the finger portions are joined to a different finger portion by solid arcuate portions 201 thus forming a interconnects series of finger portions with slots 205 open at the top and slots 202 open at the bottom of the collet. The outer surface of each finger portions 203, 204 of the collet is provided with a plurality of ribs 47, the lowermost ribs 49 having a greater width than that of ribs 47. In a similar fashion the inner surface of each finger portion 203 and 204 are provided with a plurality of ribs 52 and the lowermost rib 206 has a greater width than that of ribs 52.

Operation of the jar is as follows. For jarring in the upward mode, an upward force is applied to the mandrel through work string connector 11. Upward movement of the mandrel is resisted by Belleville spring stack 79 through collet 112, compression sleeve 101 and pressure piston 93. Upward movement of the mandrel is also resisted by the fluid within the pressure chamber 82 bounded by the two pressure pistons 69 and 93. Fluid is allowed to escape from the pressure chamber by the metering orifice 80 provided in one of the pressure pistons. This arrangement acts as a hydraulic time delay to prevent premature triggering of the jar. As the mandrel continues to move upwardly as shown in FIG. 4B ribs 111 on the collet 112 will come into registry with grooves 116 provided in the inner surface of trigger sleeve 110. The proximal ribs on the collet 112 has a width greater than that of the distal ribs and the proximal groove in the trigger sleeve has a width greater than that of the distal grooves to avoid jamming or release of the collet prematurely in a manner known in the art. Once ribs 111 and grooves 116 are in alignment the collet finger expands outwardly and the mandrel is released. This drives hammer portion 152 of enlarged portion 17 of the mandrel against anvil portion 151 of sealing cap 14, as shown in FIG. 1B.

At this point the Belleville spring stack will act to move trigger sleeve 110 to the right looking at FIG. 4B through pressure piston 93 and compression sleeve 101. This in turn compresses coil spring 118. To reset the jar, the upward force on the mandrel is relaxed. The mandrel returns to a neutral position shown in FIGS. 1A-5A and ribs 114 on the inner surface of collet 112 engage grooves 152 on the outer surface of mandrel portion 113. The width of the grooves 152 and the ribs 114 are formed in the manner of grooves 116 and ribs 111. Compressed coil spring 118 now moves trigger sleeve to the left looking at FIG. 4B to its neutral position in FIG. 4A. During the upward jarring sequence, collet 46 remains engaged with mandrel portion 21.

Downward jarring is achieved by applying a downward force on the mandrel. Collet 46, compression sleeve 54, pressure piston 69 and Belleville spring stack all operate in a manner similar to upward jarring. Downward movement of the mandrel with respect to the housing causes collet 46 to release mandrel portion 21 after compressing Belleville spring stack 79 and moving pressure piston 69 to the right as seen in FIG. 3C. As the ribs 47 on collet 46 register with grooves 51 in trigger sleeve 39, collet 46 disengages from proximal mandrel portion 21. This will cause hammer surface 153 of enlarged portion 17 of mandrel portion 12 to strike anvil surface 154 provided on the proximal portion of filling sub housing 25 as shown in FIG. 26. This will also compress coil spring 38.

To reset the jar, downward force on the mandrel is relaxed and the mandrel will move upwardly with respect to the housing. This will bring grooves 50 on mandrel portion 21 back and into alignment with ribs 52 on the inner surface of the collet 46. At this point compressed coil spring 38 will move trigger sleeve 39 back to its neutral position.

An additional aspect of the invention involves providing a flow path 70 between mandrel portion 64 and flow sleeve 65. This can be accomplished by providing flow channels either on the external surface of the mandrel or on the internal surface of the flow sleeve. These flow channels allow the portions of the fluid chambers distal and proximal to pressure chamber 82 to communicate so that the fluid surrounding chamber 82 is maintained at hydrostatic pressure.

Although the present invention has been described with respect to specific details, it is not intended that such details should be regarded as limitations on the scope of the invention, except to the extent that they are included in the accompanying claims.

I claim:

1. A double acting locking jar comprising:
- a housing;
- a mandrel axially movable within the housing extending from a proximal end to a distal end;
- a first release collet surrounding a proximal portion of the mandrel;
- a second release collet surrounding a distal portion of the mandrel;
- a pair of spaced apart pressure pistons positioned within the housing and surrounding the mandrel;
- a pressure chamber formed between the pressure pistons;
- a spring located within the pressure chamber;
- a first flow passage in one of said pressure pistons and a second flow passage in one of said pressure pistons for enabling selective flow of a fluid into and out of the pressure chamber; and
- means for compressing the spring in response to axial movement of the mandrel.

2. A double acting locking jar according to claim 1 wherein the means for compressing the spring in response to axial movement of the mandrel comprises a pair of compression sleeves having a first end and a second end, the compression sleeves engaging one of the pressure pistons at the first end and engaging one of the collets at the second end.

3. A double acting locking jar according to claim 1 further including a flow sleeve surrounding a central portion of the mandrel and extending beyond the pressure pistons at each end of the flow sleeve, and a flow channel between the central portion of the mandrel and the flow sleeve whereby pressure within the tool housing on either side of the pressure chamber is maintained at hydrostatic pressure.

4. A double acting locking jar according to claim 1 further including a distal pressure chamber formed between a distal end portion of the mandrel and a distal portion of the housing, a floating balance piston positioned in the chamber, the distal portion of the chamber being in fluid communication with the fluid passageway of the mandrel and the proximal portion of the chamber being in fluid communication with an interior portion of the tool.

5. A double acting locking jar according to claim 1 further including a pair of trigger sleeves each positioned between one of the collets and the housing.

6. A double acting locking jar according to claim 5 further including a pair of coil springs each positioned between an end portion of the trigger sleeve and a portion of the housing, said coil springs being adapted to return the trigger sleeve to a set position after the jar has been triggered and the force of the jar has been relieved.

7. A double acting locking jar according to claim 1 wherein each collet includes a plurality of ribs of varying width on an interior surface of a plurality of flexible fingers, and the exterior surface of the mandrel includes a plurality of grooves of varying widths that correspond to the width of the ribs on the collet when the collet engages the mandrel.

8. A double acting locking jar according to claim 7 further comprising a pair of trigger sleeves each positioned between one of the collets and the housing, each collet having a plurality of fingers with ribs of varying widths on their outer surface, each trigger sleeve having a plurality of grooves on their inner surface of varying widths that correspond to the widths of the ribs on the outer surface of the collet when the jar is in a neutral position.

9. A double acting locking jar according to claim 1 further comprising a work string connector attached to the proximal end portion of the mandrel and a lower connector housing portion have external threads for connection to a section of a work string.

10. A double acting locking jar according to claim 1 wherein the mandrel includes a work string connecting portion that includes a plural of splines on its exterior surface that slide within a plurality of grooves provided in an interior surface of the housing.

11. A double acting locking jar comprising:
- a housing;
- a mandrel axially movable within the housing;
- a first release collet surrounding a proximal portion of the mandrel;
- a second release collet surrounding a distal portion of the mandrel;
- a pair of spaced apart spring abutment members positioned within the housing and surrounding the mandrel;
- a chamber formed between the spring abutment members;
- a spring located within the chamber; and
- means for compressing the spring in response to axial movement of the mandrel.

12. A double acting locking jar according to claim 1 wherein the mandrel includes a fluid passageway extending from a proximal end to a distal end.

* * * * *